US006915963B2

(12) United States Patent
Steiger

(10) Patent No.: US 6,915,963 B2
(45) Date of Patent: Jul. 12, 2005

(54) SPRAYING METHOD AND A SPRAY SYSTEM FOR COATING LIQUIDS

(75) Inventor: Ronald Steiger, Rödermark (DE)

(73) Assignee: ITW Oberflachentechnik GmbH & Co. KG, Dietzenbach (DE)

( * ) Notice: Subject to any disclaimer, the term of this patent is extended or adjusted under 35 U.S.C. 154(b) by 300 days.

(21) Appl. No.: 10/042,395

(22) Filed: Jan. 11, 2002

(65) Prior Publication Data

US 2002/0092923 A1 Jul. 18, 2002

(30) Foreign Application Priority Data

Jan. 13, 2001 (DE) ..... 101 01 369

(51) Int. Cl.[7] ..... B05B 1/24; B05B 15/00

(52) U.S. Cl. ..... 239/128; 239/132; 239/132.1; 239/132.3; 239/132.5

(58) Field of Search ..... 239/128, 132, 239/132.1, 132.3, 132.5, 700, 225.1, 240, 589, DIG. 14, 538, 290, 291, 293

(56) References Cited

U.S. PATENT DOCUMENTS

| | | | | |
|---|---|---|---|---|
| 3,606,154 A | | 9/1971 | Tufts | |
| 3,731,145 A | | 5/1973 | Senay | |
| 3,858,072 A | * | 12/1974 | Dembovsky | 313/32 |
| 4,236,059 A | * | 11/1980 | McComas et al. | 219/121.36 |
| 4,275,838 A | | 6/1981 | Fangmeyer | |
| 4,283,925 A | * | 8/1981 | Wildfeuer | 62/434 |
| 4,505,430 A | | 3/1985 | Rodgers et al. | |
| 4,597,919 A | * | 7/1986 | Ramser et al. | 75/339 |
| 4,844,348 A | * | 7/1989 | Rutz | 239/703 |
| 4,928,883 A | * | 5/1990 | Weinstein | 239/223 |
| 5,065,692 A | | 11/1991 | Hollesen et al. | |
| 5,106,025 A | | 4/1992 | Giroux et al. | |
| 5,120,582 A | * | 6/1992 | Browning | 427/446 |
| 5,209,948 A | | 5/1993 | Talacko | |
| 5,219,690 A | | 6/1993 | Hammond | |
| 5,233,153 A | * | 8/1993 | Coats | 219/121.47 |
| 5,639,027 A | | 6/1997 | Fritz | |
| 5,707,009 A | | 1/1998 | Schneider | |
| 5,845,846 A | | 12/1998 | Watanabe et al. | |
| 5,914,153 A | | 6/1999 | Swink et al. | |
| 5,948,476 A | | 9/1999 | Otake et al. | |
| 6,050,499 A | | 4/2000 | Takayama et al. | |
| 6,081,281 A | | 6/2000 | Cleary et al. | |
| 6,273,344 B1 | | 8/2001 | Liu | |

FOREIGN PATENT DOCUMENTS

| | | |
|---|---|---|
| DE | 220888 | 4/1910 |
| DE | 825379 | 12/1951 |
| DE | 847 578 | 8/1952 |
| DE | 913 520 | 7/1954 |
| DE | 3000002 | 7/1981 |
| DE | 3105186 | 9/1982 |
| DE | 3135721 | 3/1983 |
| DE | 3225844 | 1/1984 |
| DE | 86 07 841 U | 5/1986 |
| DE | 3509874 | 9/1986 |
| DE | 3504167 | 7/1987 |
| DE | 40 17 603 C | 7/1991 |
| DE | 40 17 603 C1 | 7/1991 |
| DE | 44 43 811 A1 | 6/1996 |
| DE | 198 16 648 A1 | 11/1998 |
| EP | 0 237 668 A1 | 9/1987 |
| EP | 0 237 668 A | 9/1987 |
| EP | 0 283 917 A | 9/1988 |
| EP | 0 480 226 A | 4/1992 |

(Continued)

*Primary Examiner*—Davis Hwu
(74) *Attorney, Agent, or Firm*—Lowe Hauptman & Berner, LLP

(57) ABSTRACT

Cooling gas is fed through a cooling-gas line (14) to a liquid atomizer, preferably an atomizing bell (4) in order to cool its end surface (24) configured underneath streaming coating liquid and therefore in contact with the ambient air. The cooling reduces coating deposition at this end surface or reduces the rate of layering.

28 Claims, 1 Drawing Sheet

FOREIGN PATENT DOCUMENTS

| | | |
|---|---|---|
| EP | 0827781 | 3/1998 |
| EP | 0 878 238 A | 9/1998 |
| EP | 1 048 359 A2 | 11/2000 |
| FR | 626 199 A | 7/1989 |
| GB | 2076697 | 12/1981 |
| JP | 59 093804 A | 5/1984 |

* cited by examiner

SPRAYING METHOD AND A SPRAY SYSTEM FOR COATING LIQUIDS

FIELD OF THE INVENTION

The present invention relates to a spraying method and a spray system.

Spraying methods and spray systems are known in practice.

Bell-shaped rotary atomizers in the form of a bell which atomize and spray a coating liquid on an object to be coated are known from the U.S. Pat. Nos. 4,275,838 and 4,505,430 and from the German patent documents 30 00 002 A1 and 35 09 874 A1. These documents disclose applying a high voltage, which may be negative or positive, to the rotary atomizers and/or the spray coating liquid. The high voltage typically is between 4 kv and 140 kv. A high voltage spray system fitted with an irrotational spray nozzle is known from the U.S. Pat. No. 3,731,145.

A coating liquid may cure if exposed to air (oxygen). Volatile ingredients of the coating liquid, in particular solvents in lacquers/enamels and water in water soluble lacquers/enamels shall evaporate the faster the warmer their ambience. Liquid particles cast away from the coating liquid's spray jet deposit on the surfaces of the spray system where they will cure. Moreover curing layers of coating liquid will also materialize on the front side under the flow of coating liquid, or in other designs, on the rotating atomizing bell's or atomizing pane's back side situated under the flow of coating liquid.

SUMMARY OF THE INVENTION

The objective of the present invention is to prevent in simple manner the formation of a curing layer of coating liquid on the surfaces of the spray system or at least to reduce the rate of drying of coating liquids on such surfaces.

Accordingly the invention relates to a coating-liquid spraying method whereby coating liquid is sprayed from a spray system through a liquid atomizer in the form of an irrotational nozzle or in the form of a rotating rotary atomizing element onto an object to be coated, said method being characterized in that at least one spray-system component on which the coating liquid might deposit and cure shall be cooled by a fluid, cooled coolant which is applied to said component during spray coating in order that cooling said component shall reduce or prevent adhesion and/or the rate of drying and layering of coating liquid on surfaces of said component.

Moreover the invention relates to a liquid-coating spray system containing a liquid atomizer in the form of an irrotational nozzle or in the form of a rotating rotary atomizing element that sprays coating liquid onto an object to be coated, where said system is characterized by a cooling unit cooling a component of the spray system by means of a fluid, cooled coolant during spray coating where coating liquid may deposit on said component and consequently cooling said component shall reduce or prevent adhesion and/or the coating liquid's rate of drying and its layering on surfaces of said component.

Preferably the coolant shall be fed through the cooling unit to the liquid atomizer, especially when latter is a rotary atomizing element in order to cool latter at a surface which is situated in the ambient air and on which flows the coating liquid.

Preferably the coolant shall be a gas, in particular air, that is blown as cooled compressed air onto the surface to be cooled. This step can be implemented by a simple cooling system and by simple coolant lines.

The coolant, ie the gas, is cooled by a cooling system preferably affixed to the spray system or integrated into it. So-called cooling-gas cartridges are especially applicable.

Preferably the cooling unit shall be fitted with a compressed-gas discharge to blow cooled compressed air onto a surface of the component to be cooled, said surface being free of coating liquid and out of reach of it.

The spray system may be kept in part or as a whole at a positive or negative electric potential for instance between 4 kv and 140 kv. The voltage may be constant or variable. Just as in the state of the art, the spray system of the invention may be fitted with one or more of the following compressed-air supplies: "shaping air" which is configured relative to the spray jet and for instance encloses it in bell-shaped manner and flows with it in order to shape it; "bearing air" supporting the rotary atomizing element and/or a turbine driving it; "turbine air" to drive the turbine; "braking air" to decelerate the turbine and the rotary atomizing element. Each of such "air" may be cooled by the cooling unit and in turn be used as a coolant in the spray system in order to cool the spray system or some of its components.

The coating liquid may contain solvents or be water-dilutable, in particular it may be paint, for instance colored or clear lacquer/enamel.

The rotary atomizing element usually assumes a bell shape and is also known as "aerobell" or a pane shape (also known as "turbodisk") and may rotate at up to 60,000 rpm.

BRIEF DESCRIPTION OF THE DRAWINGS

The invention is elucidated below in relation to a preferred embodiment and to the attached drawings.

DETAILED DESCRIPTION OF THE INVENTION

Figure 1:
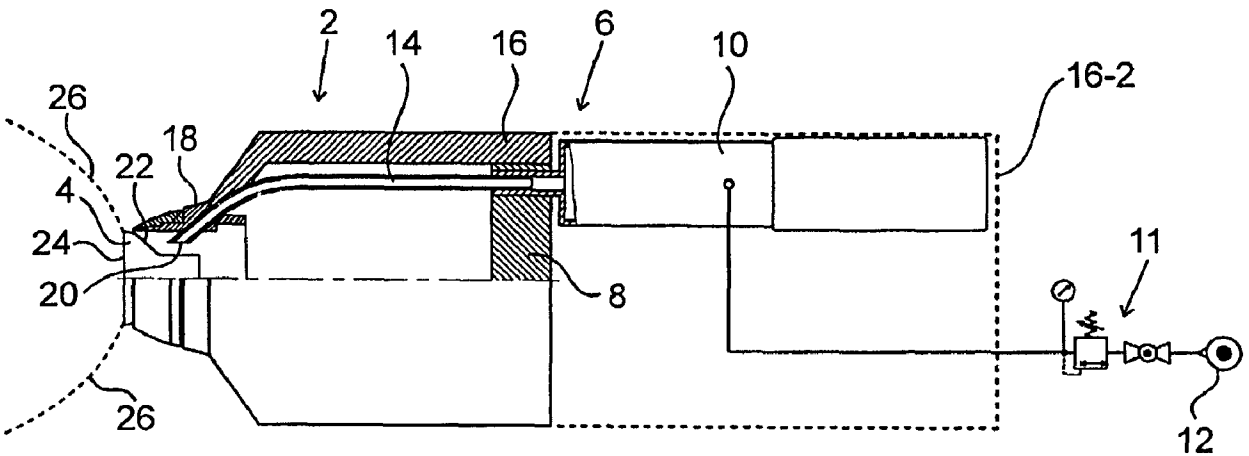
FIG. 1 is a schematic sideview, partly in longitudinal section, of a spray system of the invention.
Figure 2:
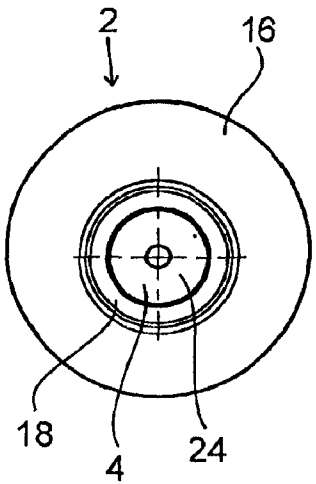
FIG. 2 is a front view from the left of the spray system of FIG. 1.

The spray system 2 of the invention shown in the drawings contains a rotating atomizing bell 4 driven by an omitted gas turbine and used to atomize coating liquid.

A cooling unit 6 comprises a cooling element 10 which is affixed to the rear end 8 of the spray system 2 and illustratively contains a so-called cooling cartridge to cool compressed gas, for instance compressed air, from a compressed-gas source 12. The compressed gas cooled by the cooling element 10 flows through a line 14 running inside a spray system housing 16 and through an annular hood 18 at the front end of the spray system end. The compressed gas is guided in metered or controlled manner by a metering or control system 11 from the compressed-gas source 12 through the cooling element 10 where it is cooled and thereupon it is guided through the cooling-gas line 14 and next it is blown through the line discharge 20 onto the external peripheral surface 22 of the atomizing bell 4. The cold of the cooled compressed gas passes through the atomizing bell 4 and in the process cools also latter's front side 24 by means of which the coating liquid is expelled radially outward on account of the centrifugal force of the rotating atomizing bell 4 and flung obliquely forward in the form of a liquid spray jet 26.

The cooling-gas line 12 may be fitted with several line discharges 20 distributed along the external periphery of the atomizing bell 4. The line discharge(s) 20 may assume the shape of round or polygonal apertures or of slit nozzle(s).

The coating liquid is fed through a central liquid feed line to the atomizing bell 4 in the manner of the state of the art.

The system housing 16 may run as shown in a dashed line 16-2 in FIG. 1 around the cooling element 10 and thereby integrate the cooling element 10 into the spray system 2.

What is claimed is:

1. A spray coating method, comprising the steps of:

spraying a coating liquid from a spray system through a liquid atomizer in the form of an irrotational nozzle or in the form of a rotary atomizing element onto an object to be coated; and cooling at least one component of the spray system, where the coating liquid may deposit on said component and cure on it, by a fluid, cooled coolant that is fed to said component during said spraying;

wherein the cooling of said component is performed to an extent sufficient to reduce or prevent the adhesion and/or the drying rate and the layering of the coating liquid on a surface of said component;

a compressed gas is used as the coolant; and the compressed gas is blown onto a surface region of the component to be cooled, where the coating liquid does not stream over said surface region.

2. The method as claimed in claim 1, wherein the liquid atomizer is a rotary atomizing element.

3. The method as claimed in claim 1, further comprising cooling the compressed gas, by a cooling element, prior to blowing said cooled, compressed gas onto said surface region of the component to be cooled.

4. The method of claim 1, wherein the cooling of said component is performed to an extent sufficient to prevent the adhesion and/or the layering of the coating liquid on said surface of said component.

5. A spray system for spraying coating liquids, said system comprising:

a liquid atomizer in the form of an irrotational nozzle or in the form of a rotating rotary atomizing element for spraying a coating liquid onto an object to be coated; and a cooling unit for cooling a component of the spray system by means of a fluid, cooled coolant during spray coating, where the coating liquid may deposit and cure on said component, the cooling of said component reducing or preventing both the coating liquid's adhesion to and/or the drying rate on and its layering on a surface of said component;

wherein the coolant is a compressed gas;

the cooling unit is fitted with a compressed-gas discharge to blow the cooled compressed gas onto a surface region of the component to be cooled, where the coating liquid does not stream over said surface region; and the system further comprises a cooling element of the cooling unit to cool the compressed gas.

6. The system as claimed in claim 5, wherein the liquid atomizer is a rotary atomizing element.

7. A method of spraying a coating liquid onto an object to be coated, said method comprising the steps of:

providing a spray discharging system having a rotary atomizer for atomizing said coating liquid, said atomizer having a rear end and a front end, said atomizer longitudinally extending from the rear end to the front end and towards the object, said atomizer having an external surface, an internal surface that defines an inner passage for the coating liquid, and an atomizing edge in the front end and at the boundary of the internal and external surfaces;

atomizing and spraying the coating liquid from the atomizing edge onto the object;

cooling said atomizer during said atomizing and spraying step by a cooling medium deposited on the external surface of said atomizer; and cooling the cooling medium prior to depositing said cooling medium onto the external surface of said atomizer.

8. The method of claim 7, wherein said cooling step comprises indirectly cooling said atomizing edge, by depositing said cooling medium on the external surface of said atomizer in a region other than a vicinity of said atomizing edge, to an extent sufficient to prevent precipitation of the coating liquid on the external surface in the vicinity of said atomizing edge during said atomizing and spraying step.

9. The method of claim 7, wherein said cooling step comprises directly depositing the cooling medium on the rear end of said atomizer in a region rearwardly, longitudinally spaced from said atomizing edge.

10. The method of claim 7, wherein said cooling step comprises directly depositing the cooling medium on the external surface of said atomizer in a region that is not accessible to by the coating liquid during said atomizing and spraying.

11. The method of claim 7, wherein said coating liquid is water-based paint.

12. The method of claim 7, wherein said atomizer is a rotary, bell-shaped atomizing element having a front end portion flared towards the object and a rear end portion extending rearwardly from a region of said front end portion, which region has a smallest diameter of said front end portion, and said cooling medium is directly deposited on said rear end portion of the atomizing element.

13. The method of claim 12, wherein said cooling medium is cooled compressed air.

14. The method of claim 7, wherein said cooling medium is a compressed gas;

said method further comprising:

providing a cooling element; and cooling the compressed gas, by said cooling element, prior to depositing said compressed gas onto the external surface of said atomizer.

15. The method as claimed in claim 14, further comprising supplying, besides said compressed gas, shaping air; and shaping a spray jet of said coating liquid, which is being sprayed from the atomizing edge onto the object, with said shaping air.

16. The method as claimed in claim 15, further comprising cooling said shaping air, with a cooling unit, prior to said shaping.

17. The method as claimed in claim 7, wherein said cooling comprises blowing a compressed bas onto the extemal surface, without affecting the shape of a spray jet of said coting liquid being sprayed from the atomizing onto the object.

18. A spray system for coating an object with a coating liquid, said system comprising:

a rotary liquid atomizer for atomizing and spraying the coating liquid onto the object, said atomizer having longitudinally spaced rear and front end portions, said atomizer having an external surface, an internal surface that defines an inner passage for the coating liquid, and an atomizing edge in the front end portion and at the boundary of the internal and external surfaces from which edge the coating liquid is to be dispensed as a spray;

a cooling unit having a coolant line fitted with at least one cooling medium outlet pointing at the rear end portion of said atomizer in order to deposit a cooling medium onto the external surface of said atomizer, thereby preventing or delaying precipitation of the coating liquid on said external surface in a vicinity of said atomizing edge.

19. The system of claim 18, wherein the cooling medium outlet of said cooling unit points at a location on the external surface of said rear end portion, which location is rearwardly, longitudinally spaced from said vicinity of said atomizing edge; and the coolant line is located outside said inner passage.

20. The system of claim 18, further comprising said cooling medium, which is a compressed gas, wherein said cooling unit includes a blower for blowing said compressed gas onto said atomizer;

a gas reservoir; and a cooling element for receiving the compressed gas from said gas reservoir, cooling said compressed gas and delivering said cooled, compressed gas to said blower.

21. The system of claim 18, wherein further comprising said cooling medium which is compressed air.

22. The system of claim 18, wherein said cooling medium outlet includes at least one polygonal apertures or slit nozzles.

23. The system of claim 18, wherein said atomizer is a rotary, bell-shaped atomizing element having a front end portion flared towards the object and a rear end portion extending rearwardly from a rear region of said front end portion, which rear region has a smallest diameter of said front end portion, and the cooling medium outlet of said cooling unit points at said rear end portion of the atomizing element.

24. The system of claim 18, wherein the cooling medium outlet of said cooling unit points at a region on the external surface of said atomizer, which region is not accessible to by the coating liquid during said atomizing and spraying, thereby indirectly cooling the atomizing edge without affecting the shape of the spray.

25. The system of claim 18, further comprising a shaping air outlet pointing at the vicinity of said atomizing edge for discharging compressed air to shape said spray, said shaping air outlet and said cooling medium outlet being longitudinally spaced from each other.

26. The system of claim 18, wherein said cooling unit further includes a reservoir of said cooling medium; and a cooling cartridge having an inlet coupled to said reservoir to receive the cooling medium from said reservoir, and an outlet coupled to said coolant line for cooling said cooling medium before delivering said cooled, cooling medium to said coolant line;

wherein said at least one cooling medium outlet is formed in the coolant line to be spaced from the rear end portion of said atomizer by a distance shorter than a length of said coolant line between the outlet of the cooling cartridge and said at least one cooling medium outlet.

27. The system of claim 18, wherein said at least one cooling medium outlet is positioned adjacent the rear end portion of said atomizer so as to directly deposit the cooling medium onto the external surface of said rear end portion.

28. A method of spraying a coating liquid onto an object to be coated, said method comprising the steps of:

providing a spray discharging system having a rotary atomizer for atomizing said coating liquid, said atomizer having a rear end and a front end, said atomizer longitudinally extending from the rear end to the front end and towards the object, said atomizer having an external surface, an internal surface that defines an inner passage for the coating liquid, and an atomizing edge in the front end and at the boundary of the internal and external surfaces;

atomizing and spraying the coating liquid from the atomizing edge onto the object;

cooling said atomizer during said atomizing and spraying step by a cooling medium deposited on the external surface of said atomizer;

supplying to said atomizer, besides said cooling medium, at least one of (a) shaping air for shaping a spray jet of said coating liquid being sprayed from the atomizing edge onto the object, (b) bearing air for supporting the atomizer which is a rotary atomizing element, (c) turbine air for rotating the rotary atomizing element, and (d) braking air for decelerating the rotary atomizing element;

providing a cooling unit; and cooling said at least one of shaping air, bearing air, turbine air and braking air with said cooling unit prior to said supplying.

* * * * *